US009895031B2

(12) United States Patent
Hsu

(10) Patent No.: US 9,895,031 B2
(45) Date of Patent: Feb. 20, 2018

(54) QUICK RELEASE CURTAIN SUPPORT ASSEMBLY

(71) Applicant: Shaoxing County Runzhuo Home Textile Co. LTD, Shaoxing (CN)

(72) Inventor: Pong-Chang Hsu, City of Industry, CA (US)

( * ) Notice: Subject to any disclaimer, the term of this patent is extended or adjusted under 35 U.S.C. 154(b) by 0 days.

(21) Appl. No.: 14/829,274

(22) Filed: Aug. 18, 2015

(65) Prior Publication Data

US 2017/0049275 A1 Feb. 23, 2017

(51) Int. Cl.

| | |
|---|---|
| ***A47K 3/00*** | (2006.01) |
| ***A47K 3/38*** | (2006.01) |
| ***A47H 13/00*** | (2006.01) |
| ***A47H 13/02*** | (2006.01) |

(52) U.S. Cl.

CPC ..... *A47K 3/38* (2013.01); *A47H 13/00* (2013.01); *A47H 13/02* (2013.01)

(58) Field of Classification Search

CPC ..... A47K 3/38
USPC ..... 4/596–614
See application file for complete search history.

(56) References Cited

U.S. PATENT DOCUMENTS 2,219,075 A * 10/1940 Le Veau ..... A47H 15/00 16/87.6 R
2,573,985 A * 11/1951 Porter ..... A47K 3/38 4/610
2,711,555 A * 6/1955 Hanson ..... A47H 13/01 16/87.2
3,045,251 A * 7/1962 Weingart ..... A47K 3/38 248/68.1
3,766,572 A * 10/1973 Wright ..... A47K 3/38 4/610
4,769,862 A * 9/1988 Skrzelowski ..... A47K 3/38 16/87.4 R
5,022,104 A * 6/1991 Miller ..... A47K 3/38 160/330
5,031,257 A * 7/1991 Jeffery ..... A47K 3/38 16/94 D
5,169,100 A * 12/1992 Milcent ..... H02G 3/26 248/224.7
5,345,992 A * 9/1994 Turner ..... A47K 3/38 16/87.2
D392,177 S * 3/1998 Ouellette, Sr. ..... A47K 3/38 D8/380

(Continued)

*Primary Examiner* — Lori Baker
(74) *Attorney, Agent, or Firm* — Tommy SF Wang; Wang IP Law Group, P.C.

(57) ABSTRACT

A curtain support assembly enables quick, one-handed installation and removal of a panel, such as a shower curtain, from a shower rod. The assembly includes a panel, a first mounting bracket, and a second mounting bracket. The first and second mounting brackets serve to join the panel to a rod. The configuration of the mounting brackets allows the panel to be pulled from, or attached to, the rod in a singular directional motion. Each mounting bracket has a gap that extends from a central opening to a corner of the mounting bracket. When the panel, and thus, the first and second mounting brackets, are folded in a coplanar disposition, the first and second gaps mirror each other. This gap orientation enables a singular directional manipulation of the panel for attachment and detachment to the rod. Additional pairs of mounting brackets extend across the panel as additional mounting points.

20 Claims, 5 Drawing Sheets

(56) References Cited

U.S. PATENT DOCUMENTS

| | | | | |
|---|---|---|---|---|
| 6,163,899 | A * | 12/2000 | Leonard | A47H 23/06 160/330 |
| 6,931,694 | B2 * | 8/2005 | Chen | A47H 13/01 16/87.2 |
| 7,168,131 | B2 * | 1/2007 | Ruggiero | A47K 3/38 16/87.2 |
| 7,735,189 | B2 * | 6/2010 | Richardson | A47H 13/01 16/87.2 |
| 8,118,078 | B2 * | 2/2012 | Freedland | A47H 1/02 16/87.2 |
| 8,151,384 | B2 * | 4/2012 | Jankiewicz | A47K 3/38 4/610 |
| D664,423 | S * | 7/2012 | Cittadino | A47K 3/38 D8/367 |
| 2008/0178423 | A1 * | 7/2008 | Patel | A47H 13/00 16/87.2 |
| 2013/0074255 | A1 * | 3/2013 | Uncles | A47K 3/28 4/601 |

* cited by examiner

QUICK RELEASE CURTAIN SUPPORT ASSEMBLY

FIELD OF THE INVENTION

The present invention relates generally to a quick release curtain support assembly that enables one-handed manipulation of a curtain during installation and removal. More so, a curtain support assembly enables quick, one-handed installation and removal of a curtain from a rod through the use of a pair of brackets that clamp onto a curtain, and couple to the rod through a gap in the bracket; wherein the gaps for the pair of brackets are oriented to face each other such that a singular directional force detaches or attaches the panel to the rod.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, when showers are taken in bathtubs, shower curtains are used to retain the water within the confines of the bathtub. The shower curtain hangs from a curtain rod located above the shower head. The shower curtain is generally fabricated form a vinyl material that repels moisture.

It is known that a conventional system for eliminating the leakage or seepage of water from a shower normally comprises a plastic or cloth curtain disposed on the open side of the shower by means of attachment of the curtain to a traversal rod disposed above and parallel to the floor. The curtain must be securely fastened to the rod to optimize the retention of water inside the bath tub.

In many instances, a shower curtain has up to 12 grommet holes at the top, and hangs from a set of up to 12 hooks that each engage with a grommet hole, and collectively to a curtain rod located above the shower head. Attaching the hooks to the correlating grommet holes can often be difficult. This can require two hands. The present invention provides a space-creating shower curtain hook for retaining a shower curtain away from the person's body during a shower.

It is recognized that, the bathtub and the bathroom floor may be wet. This can be problematic when hanging the shower curtain on the rod, as each hook requires two hands: one hand to steady the grommet hole, and one hand to pass the hook through the correlating grommet hole.

Other proposals have involved shower curtains that help facilitate installation and removal of a shower curtain. The problem with these devices is that they still require both hands to manipulate the shower curtain relative to the shower rod.

Thus, an unaddressed need exists in the industry to address the aforementioned deficiencies and inadequacies. Even though the above cited methods for shower curtains meet some of the needs of the market, a quick release curtain support assembly that enables quick, one-handed installation and removal of a panel, to and from a rod is still desired.

SUMMARY OF THE INVENTION

The present invention is directed to a curtain support assembly that enables one-handed manipulation of a curtain during installation and removal. In one embodiment, the curtain support assembly enables quick, one-handed installation and removal of a panel, to and from a rod. The curtain support assembly includes a panel, such as a shower curtain, a first mounting bracket, and a second mounting bracket. The first and second mounting brackets serve to join the panel to a rod, such that the panel is vertically suspended from the rod. The unique configuration of the first and second mounting brackets allows the curtain rod assembly to be pulled from, or attached to, the rod in a singular directional motion. This singular directional manipulation of the panel enables quick, one-handed removal and attachment of the panel to the rod.

The panel may include, without limitation, a shower curtain. The panel is defined by a top edge, a bottom edge, and a pair of lateral edges. The panel detachably attaches to a rod through a first mounting bracket and a second mounting bracket. In one embodiment, the curtain support assembly enables the panel to be pulled off the rod through a quick, one-handed singular directional motion. Conversely, the panel may be attached to the rod through a one-handed pushing motion of the first and second mounting brackets against the rod.

The first and second mounting brackets are each bifurcated into a left shell and a right shell. A plurality of apertures in the left and right shells enable passage of at least one fastener. The fastener secures the left and right shells around the panel; thereby forming a secure gripping mechanism that joins the panel to the mounting brackets.

The first and second mounting brackets are further defined by a panel end, a rod end, an opening, and a gap. The panel end of the mounting brackets clamps onto a top edge of the panel. The rod end of the mounting brackets couples to the rod through a gap. The gap extends from the opening to a corner on the rod end of the mounting bracket. In one embodiment, the gap follows a bent path, so as to restrict passage of the rod unless a force is applied. The gap is resilient and sufficiently dimensioned, so as to enable passage of the rod into and out of the opening in the mounting bracket. In this manner, the mounting brackets may detachably couple to the rod.

The gaps for the first mounting bracket and the second mounting bracket face each other. When the panel, and thus, the first and second mounting brackets are folded in an adjacent, coplanar disposition, the gaps mirror each other. This gap orientation enables a singular directional manipulation of the panel, as a singular directional pull or push of the panel easily allows the rod to pass through both gaps.

For example, the panel may be attached or removed from the rod by pulling the panel to the left or right, depending on the orientation of the gaps. This pulling action forces the rod to pass through the gaps, either to or from the opening. Thus, this single direction manipulation is possible because of the orientation of the gaps in relation to each other when the first and second mounting brackets are folded coplanar to each other.

In some embodiments, additional pairs of mounting brackets may be paired with each their gaps facing each other. The additional mounting brackets are configured substantially the same as the first and second mounting brackets. These additional mounting brackets allows for support to a larger section of the panel along the length of the rod. In any case, each additional pair of mounting brackets includes a mounting bracket with a gap that faces the gap for the adjacent mounting bracket. Thus, a series of mounting brackets extend across the length of the panel.

In one aspect, a curtain support assembly for enabling one-handed manipulation of a curtain, comprises:

a panel, the panel defined by a top edge, a bottom edge, and a pair of lateral edges;

a first mounting bracket, the first mounting bracket defined by a first left shell and a first right shell, the first left shell and the first right shell configured to sandwich the top edge of the panel, wherein the first mounting bracket detachably fastens to the panel, the first mounting bracket further defined by first panel end, a first rod end, a first opening, and a first gap, the first panel end disposed to substantially align with the top edge of the panel, the first opening disposed in a generally concentric position in the first mounting bracket, the first gap configured to extend from the first opening to a corner in the first panel end; and a second mounting bracket, the second mounting bracket is disposed in an adjacent, spaced-apart relationship with the first mounting bracket, the second mounting bracket defined by a second left shell and a second right shell, the second left shell and the second right shell configured to sandwich the top edge of the panel, wherein the second mounting bracket detachably fastens to the panel, the second mounting bracket further defined by second panel end, a second rod end, a second opening, and a second gap, the second panel end disposed to substantially align with the top edge of the panel, the second opening disposed in a generally concentric position in the second mounting bracket, the second gap configured to extend from the second opening to a corner in the second panel end, wherein, the second gap is disposed to align with the first gap when the first mounting bracket and the second mounting bracket are positioned in a coplanar relationship.

In another aspect, the panel is a double sided shower curtain.

In another aspect, the panel is resilient.

In another aspect, the first mounting bracket further includes a plurality of first apertures, the plurality of first apertures configured to enable passage of at least one first fastener for sandwiching the top edge of the panel between the first left shell and the first right shell.

In another aspect, the at least one first fastener is a screw.

In yet another aspect, the first panel end has a semicircular shape.

In yet another aspect, the second mounting bracket further includes a plurality of second apertures, the plurality of second apertures configured to enable passage of at least one second fastener for sandwiching the top edge of the panel between the second left shell and the second right shell.

In yet another aspect, the at least one second fastener is the screw.

In yet another aspect, the second panel end has a semicircular shape.

In yet another aspect, the first opening is a circular shape.

In yet another aspect, the first opening includes a first inner perimeter that is reinforced with a semi-rigid polymer.

In yet another aspect, the second opening includes a second inner perimeter that is reinforced with a semi-rigid polymer.

In yet another aspect, the second opening is a circular shape.

In yet another aspect, the first gap and the second gap are configured to enable passage of a rod.

In yet another aspect, the rod is a shower rod disposed in a generally horizontal orientation.

In yet another aspect, the top edge of the panel is folded between about 5 to 10 degrees relative to each other to enable the coplanar relationship between the first gap and the second gap.

In yet another aspect, a singular directional force enables passage of the rod through the first gap and the second gap for attaching and detaching the panel from the rod.

In yet another aspect, the first mounting bracket and the second mounting bracket are fabricated from a rigid polymer.

In yet another aspect, the first mounting bracket and the second mounting bracket are integrally manufactured into the panel.

In yet another aspect, the assembly further includes at least one additional pair of mounting brackets.

In yet another aspect, the at least one additional pair of mounting brackets align in series with the first mounting bracket and the second mounting bracket.

One objective of the present invention is to provide one-handed installation and removal of a shower curtain to a shower rod.

Another objective is to enable one-handed orientation of the first gap and the second gap in a coplanar disposition.

Another objective is to enable quick detachment of the panel from the rod.

Yet another objective is to provide a curtain support assembly that minimized injury from slippage in a bathtub by enabling one-handed manipulation of the shower curtain.

Yet another objective is to provide a curtain support assembly that is environmentally-friendly, durable, and convenient to use.

Yet another objective is to provide a curtain support assembly that is inexpensive to manufacture.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
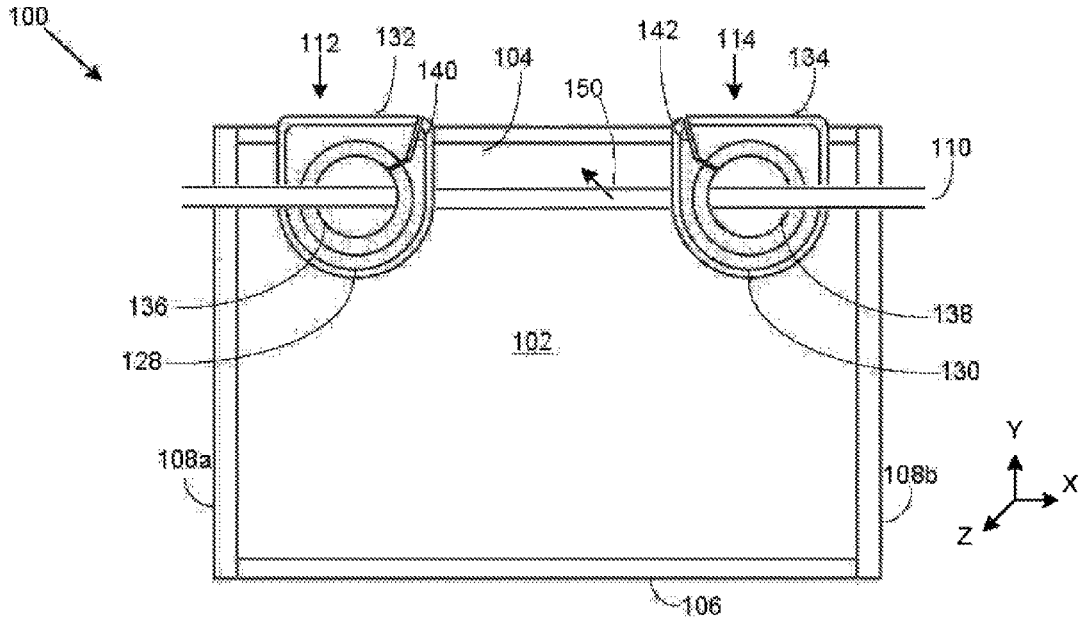
FIG. 1 illustrates a frontal view of an exemplary quick release curtain support assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-9, a quick release curtain support assembly 100 provides a panel 102, a first mounting bracket 112, and second mounting bracket 114. These components work together to enable quick, one-handed manipulation of the panel 102 for installation and removal of the panel 102 to and from a rod 110. In one embodiment, the quick release curtain support assembly 100 enables quick, one-handed installation and removal of a shower curtain, to and from a shower curtain rod.

The panel 102 may include, without limitation, a double sided shower curtain, a single sided vinyl curtain, a fabric curtain, and a theater curtain. The rod 110 may include a horizontally disposed shower rod that extends across the length of a bathtub, and has a generally circular cross section. The unique configuration that enables the quick attachment and detachment of the panel 102 to and from the rod 110 helps save time, and reduces injury by not requiring the use of both hands while standing in a wet bathtub.

As referenced in FIG. 1, the curtain support assembly 100 includes a panel 102, a first mounting bracket 112, and a second mounting bracket 114. The first and second mounting brackets 112, 114 serve to join the panel 102 to a rod 110, such that the panel 102 is vertically suspended from the rod 110. The unique configuration of the first and second mounting brackets 112, 114 allows the curtain rod assembly 100 to be pulled from, or attached to, the rod 110 in a singular directional motion. This singular directional manipulation of the panel 102 enables quick, one-handed removal and attachment of the panel 102 to the rod 110.

Figure 2:
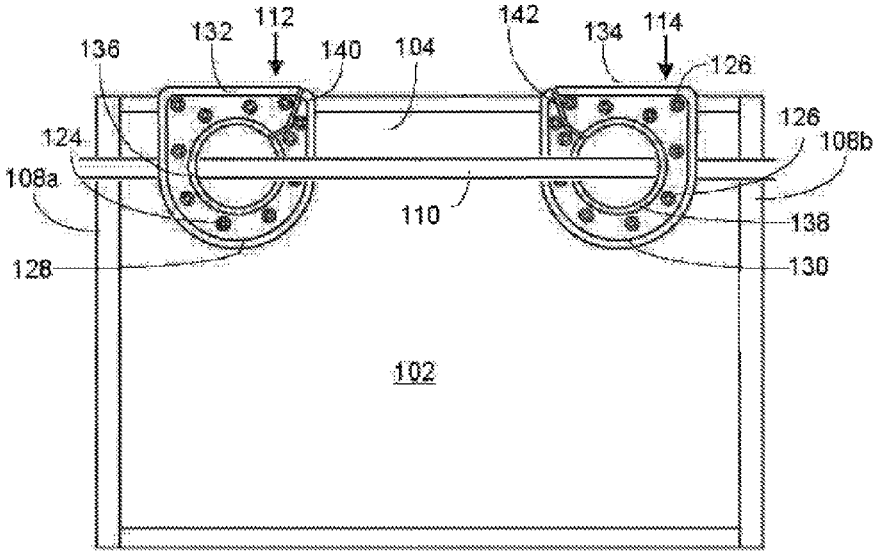
FIG. 2 illustrates a rear view of the quick release curtain support assembly, in accordance with an embodiment of the present invention.

Looking now at FIG. 2, the panel 102 is defined by a top edge 104, a bottom edge 106, and a pair of lateral edges 108*a*, 108*b*. In one embodiment, the top edge 104 is disposed above the bottom edge 106 in relation to a bathtub or other bathroom fixture. The panel 102 is generally resilient, so as to enable folding of the top edge 104 for creating a face-to-face orientation between the first and second mounting brackets 112, 114, as described below. In one possible embodiment, the panel 102 is fabricated from a moisture repelling vinyl material.

Figure 3:
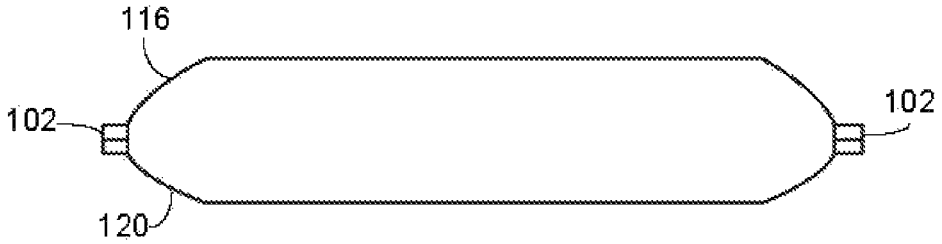
FIG. 3 illustrates a top view of the quick release curtain support assembly, in accordance with an embodiment of the present invention.
Figure 4:
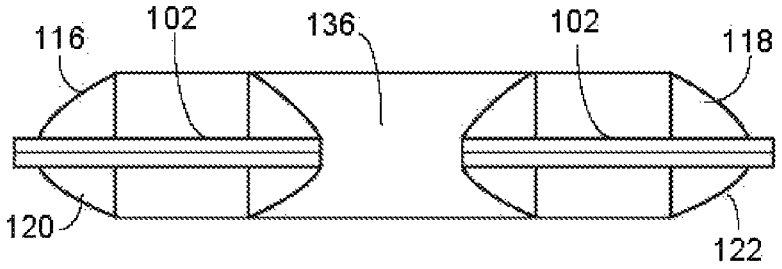
FIG. 4 illustrates a sectioned view of the quick release curtain support assembly, in accordance with an embodiment of the present invention.

Turning now to FIGS. 3 and 4, the panel 102 detachably attaches to a rod 110 through a first mounting bracket 112 and a second mounting bracket 114. In one embodiment, the curtain support assembly 100 enables the panel 102 to be pulled off the rod 110 through a quick, one-handed singular directional motion. Conversely, the panel 102 may be attached to the rod 110 through a one-handed pushing motion by pressing the first and second mounting brackets 112, 114 against the rod 110.

Figure 5:
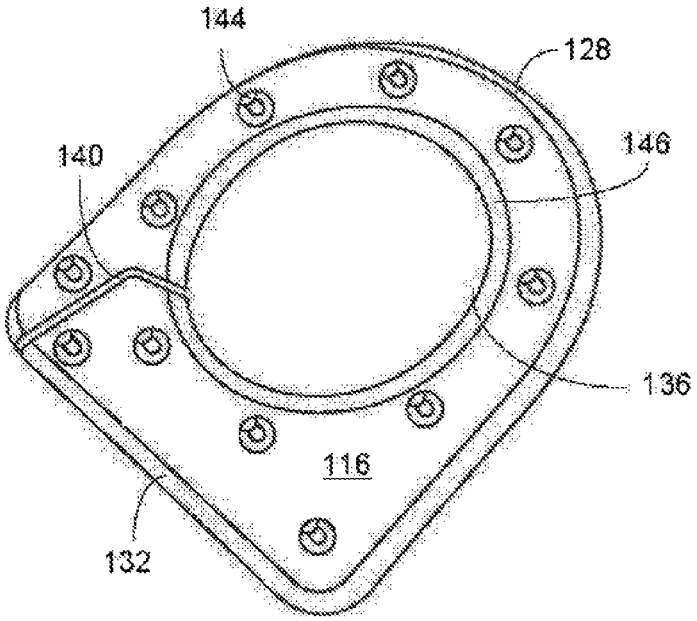
FIG. 5 illustrates a perspective view of an exemplary first left shell of an exemplary first mounting bracket, in accordance with an embodiment of the present invention.
Figure 6:
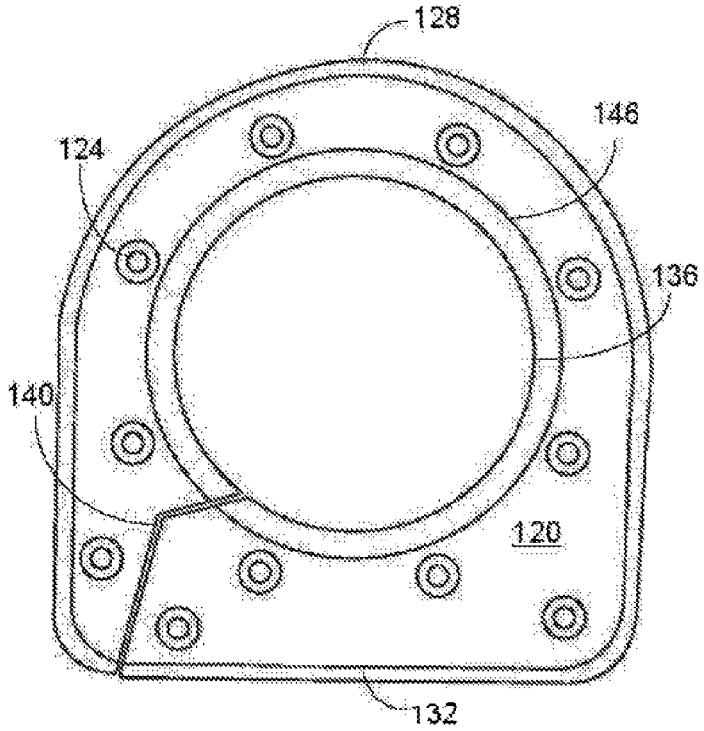
FIG. 6 illustrates a perspective view of an exemplary first right shell of the first mounting bracket, in accordance with an embodiment of the present invention.

As shown in FIGS. 5 and 6, the first mounting bracket 112 is bifurcated into a first left shell 116 and a first right shell 120. The first left shell 116 and the first right shell 120 engage each other in a coplanar, generally flat disposition. A plurality of first apertures 124 in the first left and right shells 116, 120 enable passage of at least one fastener 144. The fastener 144 secures the first left and right shells 116, 120 against the top edge 104 of the panel 102.

In one embodiment, the fastener 144 is a threaded screw and the first apertures 124 have threaded openings. Thus, the snugness of the first left and right shells 116, 120 on the panel 102 may be adjustable. In essence, the first left shell 116 and the first right shell 120 sandwich the top edge 104 of the panel 102. This forms a secure gripping mechanism that secures the panel 102 to the first mounting bracket 112.

In some embodiments, the first mounting bracket 112 is integrated into the panel 102. In other embodiments, the panel 102 is detachable by separating the first left shell 116 from the first right shell 120. Suitable materials for the first mounting bracket 112 may include, without limitation, polyurethane, polyvinyl chloride, rigid polymers, aluminum, stainless steel, and fiberglass.

In some embodiments, the first mounting bracket 112 comprises a first panel end 128, a first rod end 132, a first opening 136, and a first gap 140. The first panel end 128 clamps onto the top edge 104 of the panel 102. The first panel end 128 may include a generally semicircular shape. The first panel end 128 is disposed to substantially align with the top edge 104 of the panel 102. The first opening 136 is disposed in a generally concentric position in the first mounting bracket 112. The first opening 136 may include a circular shape. In one embodiment, the first opening 136 includes a first inner perimeter 146 that is reinforced with a semi-rigid polymer. The first rod end 132 is opposite the first panel end 128. The first rod end 132 may include a generally square shape so as to maximize surface area contact with the panel 102.

The first rod end 132 of the first mounting bracket 112 couples to the rod 110 through a first gap 140. The first gap 140 extends from the first opening 136 to a corner on the first rod end 132 of the first mounting bracket 112. In one embodiment, the first gap 140 follows a bent path, so as to restrict passage of the rod 110 unless a singular directional force 150 is applied. The first gap 140 is resilient and sufficiently dimensioned, so as to enable passage of the rod 110 into and out of the first opening 136 in the first mounting bracket 112. In this manner, the first mounting bracket 112 can detachably couple to the rod 110.

Figure 7:
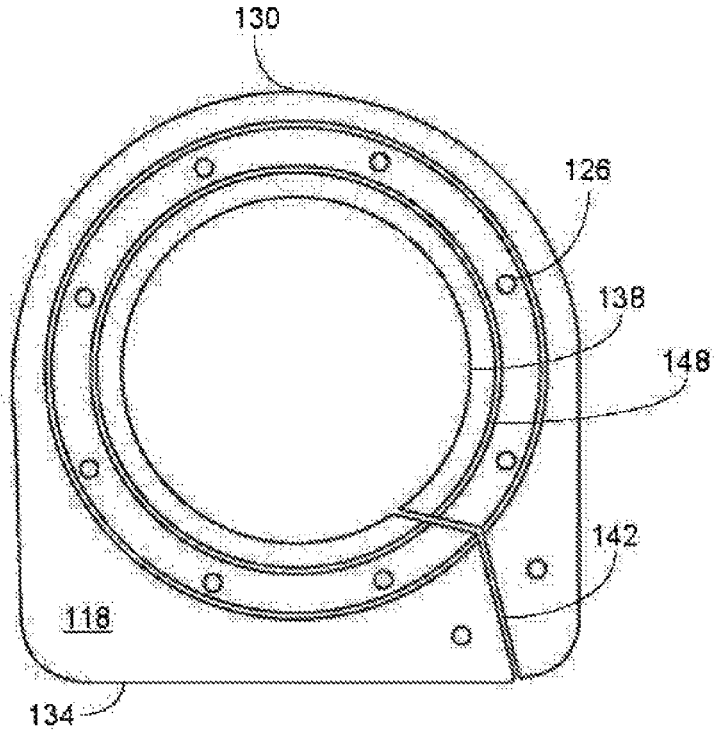
FIG. 7 illustrates a perspective view of an exemplary second left shell of an exemplary second mounting bracket, in accordance with an embodiment of the present invention.
Figure 8:
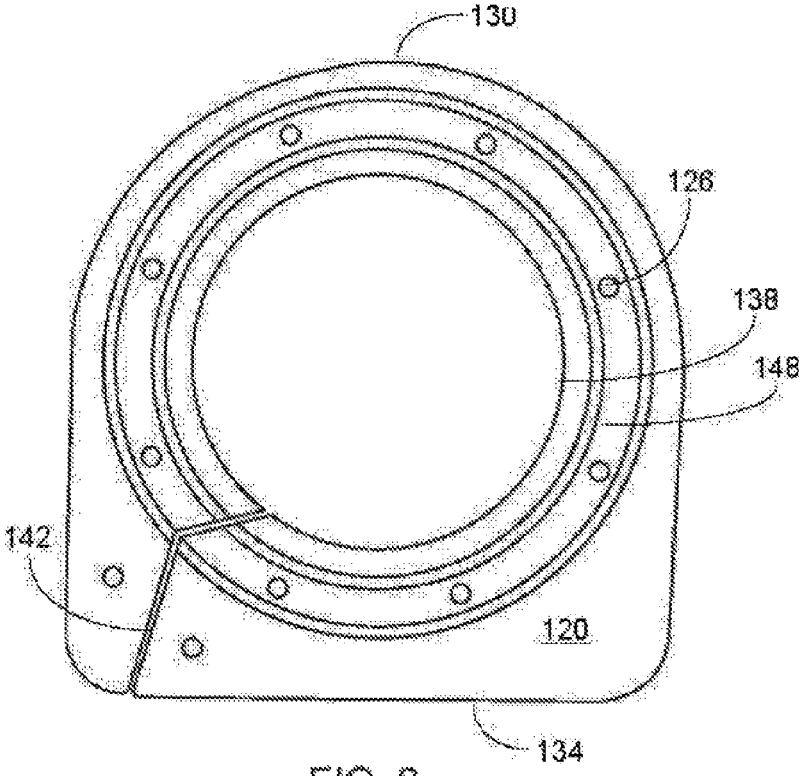
FIG. 8 illustrates a perspective view of an exemplary second right shell of the second mounting bracket, in accordance with an embodiment of the present invention.

As shown in FIGS. 7 and 8, the second mounting bracket 114 is bifurcated into a second left shell 118 and a second right shell 122. The second left shell 118 and the second right shell 122 engage in a coplanar, flat disposition. A plurality of second apertures 126 in the second left and right shells 118, 122 enable passage of at least one fastener 144. The fastener 144 secures the second left and right shells 118, 122 against the top edge 104 of the panel 102. In one embodiment, the fastener 144 is a threaded screw and the second apertures 126 have threaded openings. Thus, the snugness of the second left and right shells 118, 122 against the panel 102 may be adjustable. In essence, the second left shell 118 and the second right shell 122 sandwich the top edge 104 of the panel 102. This forms a secure gripping mechanism that secures the panel 102 to the second mounting bracket 114.

In some embodiments, the second mounting bracket 114 is integrated into the panel 102. In other embodiments, the panel 102 is detachable by separating the second left shell 118 from the second right shell 122. Suitable materials for the second mounting bracket 114 may include, without limitation, polyurethane, polyvinyl chloride, rigid polymers, aluminum, stainless steel, and fiberglass.

In some embodiments, the second mounting bracket 114 comprises a second panel end 130, a second rod end 134, a second opening 138, and a second gap 142. The second panel end 130 clamps onto the top edge 104 of the panel 102. The second panel end 130 may include a generally semi-circular shape. The second rod end 134 may include a generally square shape. The second panel end 130 is disposed to substantially align with the top edge 104 of the panel 102.

The second opening 138 is disposed in a generally concentric position in the second mounting bracket 114. The second opening 138 may include a circular shape. In one embodiment, the second opening 138 includes a second inner perimeter 148 that is reinforced with a semi-rigid polymer. The second rod end 134 is opposite the second panel end 130. The second rod end 134 may include a generally square shape so as to maximize surface area contact with the panel 102.

The second rod end 134 of the second mounting bracket 114 couples to the rod 110 through a second gap 142. The second gap 142 extends from the second opening 138 to a corner on the second rod end 134 of the second mounting bracket 114. In one embodiment, the second gap 142 follows a bent path, so as to restrict passage of the rod 110 unless a force is applied. The second gap 142 is resilient and sufficiently dimensioned, so as to enable passage of the rod 110 into and out of the second opening 138 in the second mounting bracket 114. In this manner, the second mounting bracket 114 can detachably couple to the rod 110.

Looking back at FIG. 2, the first and second gaps 140, 142 for the first mounting bracket 112 and the second mounting bracket 114 are disposed to face each other. This face-to-face configuration is what enables the quick and efficient detachment and attachment of the panel 102 to the rod 110. When the panel 102, and thus, the first and second mounting brackets 112, 114 are folded in an adjacent, coplanar disposition, the first and second gaps 140, 142 mirror each other. In one embodiment, the top edge 104 of the panel 102 is folded between about 5° to 10° relative to each other to enable the coplanar relationship between the first gap 140 and the second gap 142.

Figure 9:
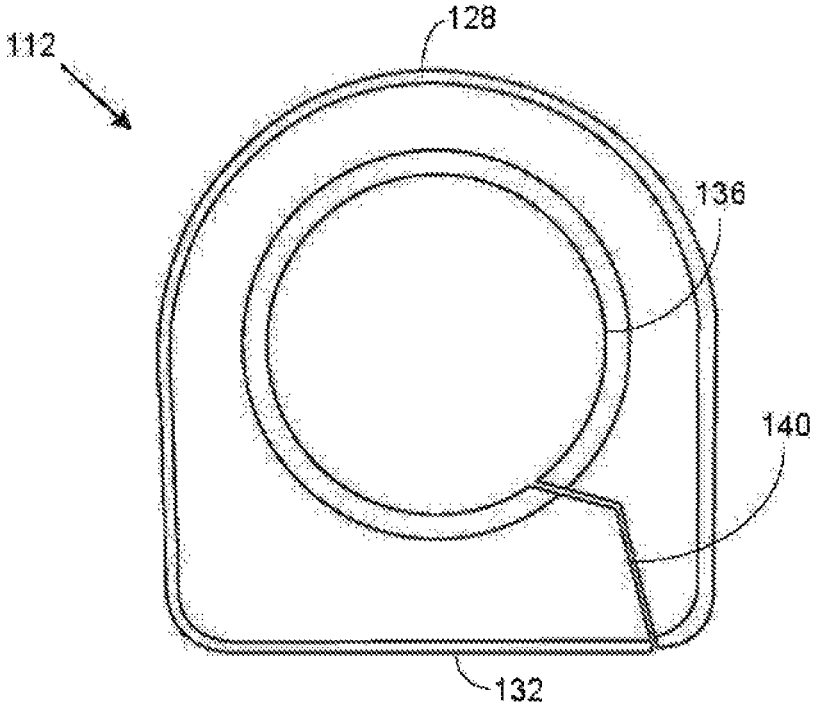
FIG. 9 illustrates a perspective view of the first mounting bracket, in accordance with an embodiment of the present invention.

This unique gap orientation brings the first and second mounting brackets 112, 114 in proximity and coplanar relationship, such that a singular directional manipulation of the panel 102 is all that is needed for attachment and detachment of the panel 102 to the rod 110. For example, a singular directional pull or push of the panel 102 easily allows the rod 110 to pass through the first and second gaps 140, 142. This is seen in FIG. 9, where the first gap 140 is bent in such a manner that a force must be applied to enable passage of the rod 110.

In another exemplary use, the panel 102 may be attached or removed from the rod 110 by pulling the panel 102 to the left or right, depending on the orientation of the first and second gaps 140, 142. This pulling action forces the rod 110 to pass through the gaps 140, 142, either to or from the opening. Thus, this single direction manipulation is possible because of the mirrored orientation of the first and second gap 140, 142 in relation to each other; and especially when the first and second mounting brackets 112, 114 are folded coplanar to each other.

In some embodiments, additional pairs of mounting brackets (not shown) may be paired with each their gaps facing each other. The additional mounting brackets are configured substantially the same as the first and second mounting brackets 112, 114. These additional mounting brackets allows for support to a larger section of the panel 102 along the length of the rod 110. In any case, each additional pair of mounting brackets includes a mounting bracket with a gap that faces the gap for the adjacent mounting bracket. Thus, a series of mounting brackets extend across the length of the panel 102.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A curtain support assembly for enabling one-handed manipulation of a curtain, the assembly comprising:

a panel, the panel defined by a top edge, a bottom edge, and a pair of lateral edges;

a first mounting bracket, the first mounting bracket defined by a first left shell and a first right shell, the first left shell and the first right shell configured to sandwich the top edge of the panel, wherein the first mounting bracket detachably fastens to the panel, the first mounting bracket further defined by first panel end, a first rod end, a first opening, and a first gap, the first panel end disposed to substantially align with the top edge of the panel, the first opening disposed in a generally concentric position in the first mounting bracket, the first gap comprises a first straight rod gap and a first straight panel gap, wherein the first straight rod gap is configured to extend from the first opening and connected to the first straight panel gap, the first straight panel gap is configured to extend to a corner in the first rod end; and a second mounting bracket, the second mounting bracket is disposed in an adjacent, spaced-apart relationship with the first mounting bracket, the second mounting bracket defined by a second left shell and a second right shell, the second left shell and the second right shell configured to sandwich the top edge of the panel, wherein the second mounting bracket detachably fastens to the panel, the second mounting bracket further defined by second panel end, a second rod end, a second opening, and a second gap, the second panel end disposed to substantially align with the top edge of the panel, the second opening disposed in a generally concentric position in the second mounting bracket, the second gap comprises a second straight rod gap and a second straight panel gap, wherein the second straight rod gap is configured to extend from the second opening and connected to the first straight panel gap, the first straight panel gap is configured to extend to a corner in the second rod end, wherein the first gap and the second gap mirror each other when the panel is folded by positioning the first mounting bracket and the second mounting bracket in a coplanar relationship.

2. The assembly of claim 1, wherein the panel is a double sided shower curtain.

3. The assembly of claim 1, wherein the panel is resilient.

4. The assembly of claim 1, wherein the first mounting bracket further includes a plurality of first apertures, the plurality of first apertures configured to enable passage of at least one first fastener for sandwiching the top edge of the panel between the first left shell and the first right shell.

5. The assembly of claim 4, wherein the at least one first fastener is a screw.

6. The assembly of claim 1, wherein the first panel end of the first mounting bracket has a semicircular shape.

7. The assembly of claim 1, wherein the second mounting bracket further includes a plurality of second apertures, the plurality of second apertures configured to enable passage of at least one second fastener for sandwiching the top edge of the panel between the second left shell and the second right shell.

8. The assembly of claim 7, wherein the at least one second fastener is the screw.

9. The assembly of claim 1, wherein the second panel end of the second mounting bracket has a semicircular shape.

10. The assembly of claim 1, wherein the first opening has a circular shape.

11. The assembly of claim 1, wherein the first opening includes a first inner perimeter that is reinforced with a semi-rigid polymer.

12. The assembly of claim 1, wherein the second opening is a circular shape.

13. The assembly of claim 1, wherein the second opening includes a second inner perimeter that is reinforced with a semi-rigid polymer.

14. The assembly of claim 1, wherein the first gap and the second gap are configured to enable passage of a rod.

15. The assembly of claim 14, wherein the rod is a shower rod disposed in a generally horizontal orientation.

16. The assembly of claim 15, wherein the top edge of the panel is folded between about 5 to 10 degrees relative to each other.

17. The assembly of claim 16, wherein a singular directional force enables passage of the rod through the first gap and the second gap for attaching and detaching the panel from the rod, the single directional force operable to force passage of the rod into and out of the first opening in the first mounting bracket.

18. The assembly of claim 1, wherein the first mounting bracket and the second mounting bracket are fabricated from a rigid polymer.

19. The assembly of claim 1, wherein the assembly further includes at least one additional pair of mounting brackets.

20. A curtain support assembly for enabling one-handed manipulation of a curtain, the assembly comprising:

a panel, the panel defined by a top edge, a bottom edge, and a pair of lateral edges;

a first mounting bracket, the first mounting bracket defined by a first left shell and a first right shell, the first left shell and the first right shell configured to sandwich the top edge of the panel, wherein the first mounting bracket detachably fastens to the panel, the first mounting bracket further defined by a plurality of first apertures, the plurality of first apertures configured to enable passage of at least one first fastener for sandwiching the top edge of the panel between the first left shell and the first right shell, the first mounting bracket further defined by first panel end, a first rod end, a first opening, and a first gap, the first panel end disposed to substantially align with the top edge of the panel, the first opening disposed in a generally concentric position in the first mounting bracket, the first gap comprises a first straight rod gap and a first straight panel gap, wherein the first straight rod gap is configured to extend from the first opening and connected to the first straight panel gap, the first straight panel gap is configured to extend to a corner in the first rod end;

a second mounting bracket, the second mounting bracket is disposed in an adjacent, spaced-apart relationship with the first mounting bracket, the second mounting bracket defined by a second left shell and a second right shell, the second left shell and the second right shell configured to sandwich the top edge of the panel, wherein the second mounting bracket detachably fastens to the panel, the second mounting bracket further defined by a plurality of second apertures, the plurality of second apertures configured to enable passage of at least one second fastener for sandwiching the top edge of the panel between the second left shell and the second right shell, the second mounting bracket further defined by second panel end, a second rod end, a second opening, and a second gap, the second panel end disposed to substantially align with the top edge of the panel, the second opening disposed in a generally concentric position in the second mounting bracket, the second gap comprises a second straight rod gap and a second straight panel gap, wherein the second straight rod gap is configured to extend from the second opening and connected to the first straight panel gap, the first straight panel gap is configured to extend to a corner in the second rod end, wherein the first gap and the second gap mirror each other when the panel is folded by positioning the first mounting bracket and the second mounting bracket in a coplanar relationship; and at least one additional pair of mounting brackets, the at least one additional pair of mounting brackets align in series with the first mounting bracket and the second mounting bracket.

* * * * *